United States Patent [19]

Hasegawa et al.

[11] 4,449,917

[45] May 22, 1984

[54] HYDRAULIC VULCANIZING PRESS

[75] Inventors: Akira Hasegawa; Yoshinori Miyamoto, both of Nagasaki, Japan

[73] Assignee: Mitsubishi Jukogyo Kabushiki Kaisha, Tokyo, Japan

[21] Appl. No.: 508,006

[22] Filed: Jun. 24, 1983

[51] Int. Cl.[3] ..... B30B 15/22; B30B 15/00

[52] U.S. Cl. ..... 425/149; 425/151

[58] Field of Search ..... 425/149, 151, 173, 78, 425/810, 145

[56] References Cited

U.S. PATENT DOCUMENTS

| | | | |
|---|---|---|---|
| 2,449,257 | 9/1948 | Tucker | 425/78 |
| 2,552,458 | 5/1951 | Reiskind et al. | 425/810 |
| 3,509,600 | 5/1970 | Noble | 425/145 |
| 3,635,622 | 1/1972 | Wechsler | 425/151 X |
| 3,642,401 | 2/1972 | Wilson | 425/173 X |
| 3,667,884 | 6/1972 | Reinfeld | 425/149 |
| 3,728,057 | 4/1973 | Grundmann et al. | 425/151 X |
| 3,734,659 | 5/1973 | Harris | 425/145 |

*Primary Examiner*—J. Howard Flint, Jr.

*Attorney, Agent, or Firm*—Wenderoth, Lind & Ponack

[57] ABSTRACT

For the purpose of pressurizing and holding the pressure in a pressurizing hydraulic cylinder is a hydraulic vulcanizing press, a pneumatic booster (more particularly, a pneumatically operated hydraulic pressure booster) for supplying a desired hydraulic pressure to the hydraulic cylinder is provided in a hydraulic circuit on a pressurizing actuation side of the pressurizing hydraulic cylinder. In addition, in the pneumatic input circuit for the pneumatic booster is provided a switching device for switching a pressurized air fed to the pneumatic booster between a high pressure air for boosting a hydraulic pressure to a desired hydraulic pressure and a low pressure air for holding the desired hydraulic pressure after the desired hydraulic pressure has been attained.

4 Claims, 5 Drawing Figures

HYDRAULIC VULCANIZING PRESS

The present invention relates to a hydraulic vulcanizing press for carrying out pressurizing of a pressurizing hydraulic cylinder and holding of the pressurizing force by making use of a pneumatic booster which converts a pneumatic pressure to a hydraulic pressure according to an area ratio of a piston and which continuously feeds the hydraulic pressure until the hydraulic pressure in the hydraulic cylinder balances with a load.

A pneumatic booster that is available in the aforementioned type of hydraulic vulcanizing press has a characteristic as illustrated in FIG. 1.

Here, it is to be noted that in the case of setting a pressing force of a hydraulic cylinder by the intermediary of the fed pneumatic pressure as the delivered hydraulic pressure is proportional to the fed pneumatic pressure;

(1) if the fed pneumatic pressure is set at a pressure corresponding to a desired hydraulic pressure for pressing, it takes time until the hydraulic cylinder is pressurized up to the desired hydraulic pressure because a delivery rate of the pressurized oil is reduced as the hydraulic pressure rises, and (2) if the fed pneumatic pressure is set higher than the pressure corresponding to the desired hydraulic pressure for pressing, the hydraulic pressure would eventually rise higher than the desired hydraulic pressure and hence a product or a machine would be adversely affected, although the time necessitated before attaining the desired hydraulic pressure is shortened.

On the other hand, if the fed pneumatic pressure is set higher than the pressure corresponding to the desired hydraulic pressure for pressing and the hydraulic pressure of a delivered pressurized oil is controlled by means of a pressure reducing valve, then the aforementioned shortcoming can be eliminated. However, the pressure reducing valve is necessitated to always discharge drain oil for controlling the hydraulic pressure, and during a pressure holding period also, even if there is no leakage from the pressing cylinder and/or other pipings, it is necessary to continue to always supply a pressurized oil, hence a correspondingly large capacity of pneumatic booster is necessitated, and moreover, waste of energy is resulted. The present invention has been proposed on the aforementioned background in the prior art.

It is therefore one object of the present invention to provide a hydraulic vulcanizing press in which a hydraulic cylinder can be pressurized up to a desired hydraulic pressure within a short period of time and can hold the desired hydraulic pressure exactly, and in which there is no waste of energy.

According to one feature of the present invention, there is provided a hydraulic vulcanizing press comprising a pneumatic booster for supplying a hydraulic pressure to a hydraulic circuit on a pressurizing actuation side of a pressing hydraulic cylinder in said hydraulic vulcanizing press in order to pressurize and hold the pressure in the pressing hydraulic cylinder, and a switching device for switching a pressurized air fed to the pneumatic booster between a high pressure air for boosting a hydraulic pressure to a desired hydraulic pressure and a low pressure air for holding said desired hydraulic pressure after said desired hydraulic pressure has been attained.

Another object of the present invention is to provide a hydraulic vulcanizing press in which a pressing force of a pressing hydraulic cylinder can be maintained at a predetermined pressure by supplying a hydraulic pressure from a hydraulic pressure generator device, and abnormal lowering of the pressing force of the pressing hydraulic cylinder can be detected at an early time to generate an alarm so that generation of an accident can be preliminarily prevented.

According to another feature of the present invention, there is provided a hydraulic vulcanizing press comprising a hydraulic pressure generator device for supplying a hydraulic pressure to a hydraulic circuit on a pressurizing actuation side of a pressing hydraulic cylinder in the hydraulic vulcanizing press in order to pressurize and hold the pressure in the pressing hydraulic cylinder, and warming means consisting of a measurement instrument for measuring a flow rate of a fluid having said hydraulic pressure and issuing a measurement signal, a setter for issuing a set signal for said flow rate, a comparator for generating an alarm signal when the measurement signal exceeds the set signal and an alarm actuated by said alarm signal.

The above-mentioned and other features and objects of the present invention will become more apparent by reference to the following description of preferred embodiments of the invention taken in conjucntion with the accompanying drawings, wherein.

In the following, one preferred embodiment of the present invention will be described with reference to the drawings.

Figure 1:
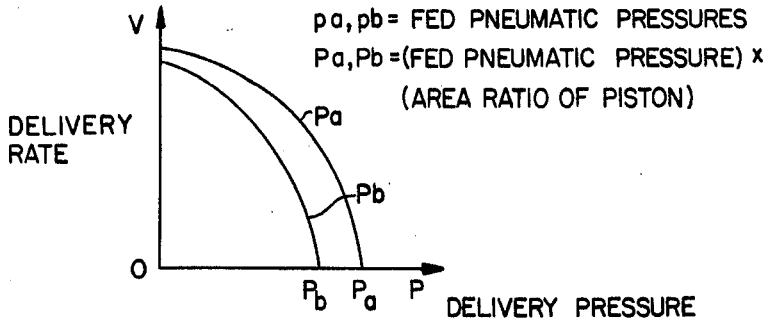
FIG. 1 is a diagram showing characteristics of a pneumatic booster.
Figure 2:
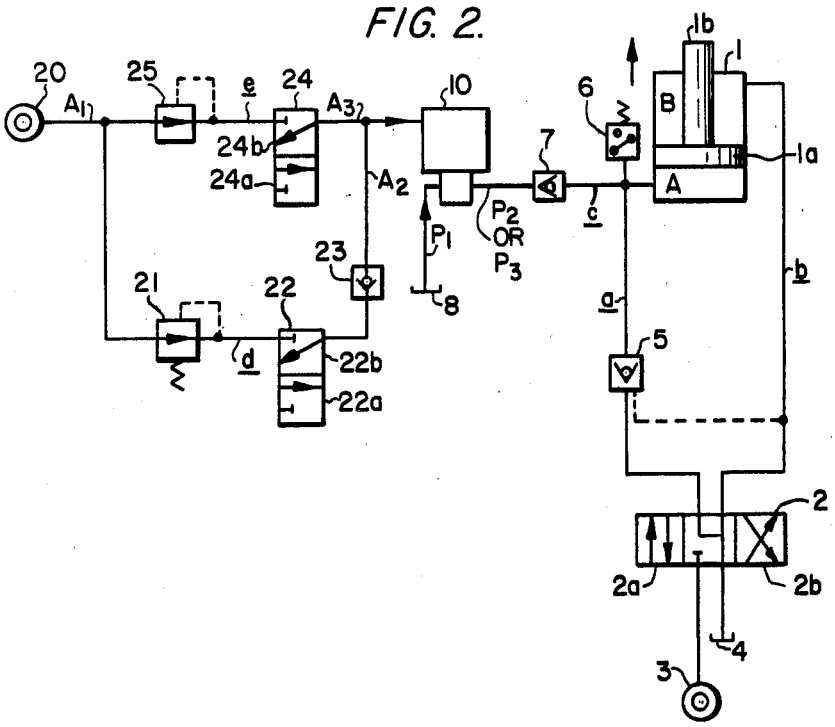
FIG. 2 is a general system diagram showing one preferred embodiment of the present invention.

In FIG. 2, reference numeral (1) designates a pressing hydraulic cylinder, for example, in a hydraulic press type tire vulcanizing press (not shown), and this pressing hydraulic cylinder (1) is adapted to clamp metallic moulds for vulcanizing a tire, that is, to apply a pressing force to the same metallic moulds, to a hydraulic chamber (A) on a side of a piston (1*a*) of the cylinder (1) is coupled a hydraulic circuit (a) on a pressurizing actuation side, while to a hydraulic chamber (B) on a side of a rod (1*b*) of the cylinder (1) is coupled a hydraulic circuit (b) on a cylinder return side, and the both hydraulic circuits (a) and (b) are coupled through a directional switching valve (2) to a low-pressure source (3) and a return tank (4). In addition, a pilot check valve (5) and a pressure switch (6) are provided. The aforementioned hydraulic circuit operates in such manner that if the directional switching valve 2 is shifted to a position (2*a*), then a hydraulic pressure supplied from the low-pressure hydraulic pressure source (3) is introduced into the hydraulic chamber (A) via the circuit (a), at the same time a liquid within the hydraulic chamber (B) is discharged to the return tank (4) via the circuit (b), and hence owing to the hydraulic pressure within the hydraulic chamber (A) the rod (1*b*) is projected by the intermediary of the piston (1*a*), resulting in pressing of a tire vulcanizing press not shown, and thereafter, if the directional switching valve (2) is shifted to a position (2*b*), a hydraulic pressure is introduced into the hydraulic chamber (B), at the same time the actuated liquid within the hydraulic chamber (A) is discharged, and so, the rod (1*b*) and the piston (1*a*) are retracted, resulting in the restored state.

In addition, to the above-mentioned hydraulic circuit (a) on a pressurizing actuation side is coupled a hydraulic pressure supplying circuit (c) having a check valve (6), and in the hydraulic pressure supplying circuit (c) between a hydraulic pressure tank (8) and the check valve (7) is disposed a hydraulic pressure generator device (10) for boosting a hydraulic pressure $P_1$ on the side of the hydraulic pressure tank (8) up to a higher hydraulic pressure of $P_2$ or $P_3$ to supply such a higher hydraulic pressure to the hydraulic cylinder (1), more particularly a pneumatic booster (10) which is pneumatically actuated to boost the original hydraulic pressure $P_1$ to the higher hydraulic pressure $P_2$ or $P_3$ to be supplied to the hydraulic cylinder (1).

Figure 3:
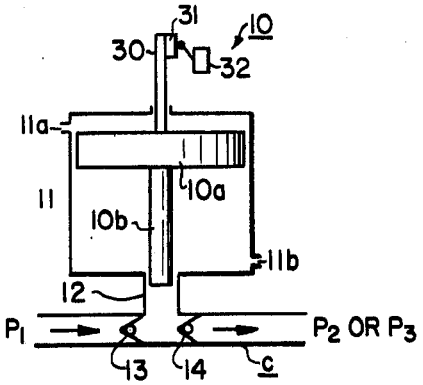
FIG. 3 is a longitudinal cross-section view of a hydraulic pressure generator device (a booster) shown in FIG. 2.

Explaining in more detail the aforementioned pneumatically actuated booster (10), as shown in FIG. 3 it consists of a pneumatic cylinder (11) formed in a broad transverse cross-section shape containing a piston (10*a*) therein and having inlet/outlet ports (11*a*) and (11*b*) for a pneumatic pressure, and a hydraulic cylinder (12) formed in a narrow transverse cross-section shape having a plunger (10*b*) advanced and retracted therethrough as communicated with the aforementioned pneumatic cylinder (11) and delimited by a pair of check valves (13) and (14) provided in the hydraulic pressure supplying circuit (c). When the plunger (10*b*) is projected into the hydraulic cylinder (12) (downwardly as viewed in FIG. 3) via the piston (10*a*) by a pressurized air flowing into the pneumatic cylinder (11) through the inlet/outlet port (11*a*) (and flowing out of the pneumatic cylinder (11) through the inlet/outlet port (11*b*)), the hydraulic pressure $P_1$ within the hydraulic cylinder (12) is raised up to a higher pressure of $P_2$ or $P_3$, and then flows into the hydraulic pressure supplying circuit (c) via the check valve (14) as shown by an arrow, whereas when a pressurized air is discharged through the inlet/outlet port (11*a*) (and enters the pneumatic cylinder (11) through the inlet/outlet port (11*b*)), the plunger (10*b*) is retracted (raised) via the piston (10*a*), hence the volume within the hydraulic cylinder (12) is increased resulting in a negative pressure therein, and so, the liquid at the hydraulic pressure $P_1$ on the side of the hydraulic pressure tank (8) flows into the hydraulic cylinder (12) through the check valve (13). Therefore, by repeating the aforementioned operations, a liquid flow at a higher hydraulic pressure $P_2$ or $P_3$ is generated in the hydraulic pressure supplying circuit (c), and this hydraulic pressure flow is supplied to the hydraulic chamber (A) of the pressing hydraulic cylinder (1) through the aforementioned hydraulic circuit (a). Here, it is to be noted that since the transverse cross-section of the pneumatic cylinder (11) has a very large area ratio with respect to the transverse cross-section of the hydraulic cylinder (12), the higher hydraulic pressure $P_2$ or $P_3$ can be obtained with a relatively low pneumatic pressure.

The pneumatic circuit for the aforementioned booster (10) consists of a feed line (d) of a pneumatic pressure $A_2$ connected between a pneumatic pressure feed source (20) and the inlet/outlet port (11*a*) of the booster (11) and including a pressure reducing valve (21), a directional switching valve (22) and a check valve (23), and a feed line (e) of a pneumatic pressure $A_3$ connected between the pneumatic pressure feed source (20) and the aforementioned inlet/outlet port (11*a*) and including a pressure reducing valve (25) and a directional switching valve (24) as shown in FIG. 2, so that by manipulating the respective directional switching valves (22) and (24) a pneumatic pressure can be either fed from the pneumatic pressure source (20) to the booster (11) through the inlet/outlet port (11*a*) or discharged from the booster (11) through the inlet/outlet port (11*a*).

The pressure reducing valves (21) and (25) are provided for the purpose of controlling a pneumatic pressure $A_1$ fed from the pneumatic pressure feed source (20), and the pneumatic pressure fed to the pneumatic booster (10) can be set at a pressure $A_2$ by the pressure reducing valve (25) and at a pressure $A_3$ by the pressure reducing valve (21). Here it is assumed that $A_3 > A_2$ is fulfilled, and in the circuit of the illustrated embodiment the set pressure in the pressure reducing valve (25) is chosen at a higher pressure of the two set pressures.

The directional switching valves (22) and (24) serve to feed the pressure at the pressures of $A_2$ and $A_3$, respectively, fed through the pressure reducing valves (21) and (25) to the booster (10) or shut out the pressure from the booster (10), and the check valve (23) serves as an inhibit valve for preventing the air at the pressure $A_3$ fed through the switching valve (24) from returning to the pneumatic pressure feed source (20) through the directional switching valve (22).

Figure 4:
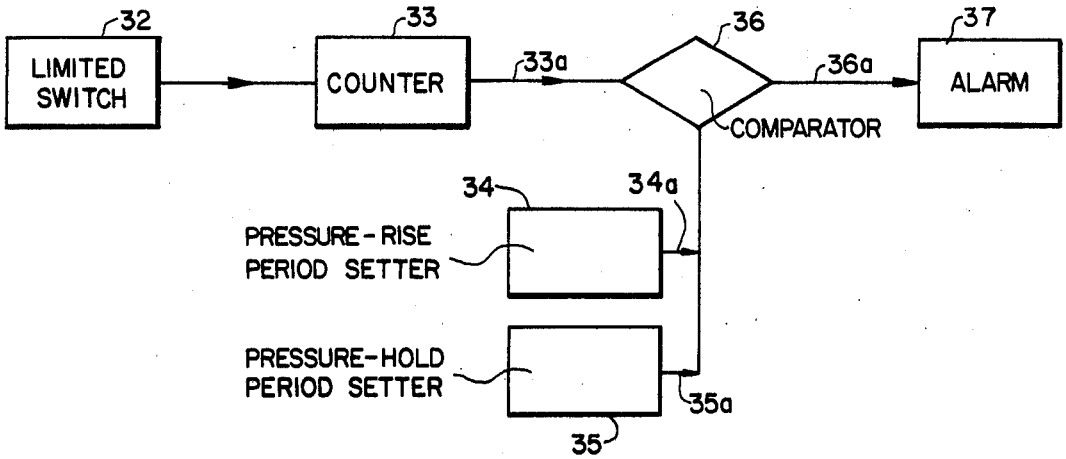
FIG. 4 is a system diagram of warning means provided in FIG. 2.

Furthermore, in the booster (10), as shown in FIG. 3 a rod (30) projecting from the pneumatic cylinder (11) is provided on the upper surface of the piston (10*a*) so that a cam (31) mounted at the tip end portion of the rod (30) may actuate a limit switch (32), also there is provided a counter (33) for counting the number of actuations of the limit switch (32) as shown in FIG. 4 to form a measurement instrument for measuring a flow rate of a hydraulic fluid generated by the booster (10) (the flow rate through the hydraulic pressure supplying circuit (c)) on the basis of the count of the counter (33) and issuing a measurement signal (33*a*). In addition, there are provided a pressure rising period setter (34) for issuing a pressure rising period set signal (34*a*) corresponding to the aforementioned measurement signal (33*a*) and a similar pressure holding period setter (35) for issuing a pressure holding period set signal (35*a*), and thereby a pressure rising period set signal (34*a*) corresponding to a number of necessary cycles of booster actuation, that is, corresponding to the aforementioned measurement signal (33*a*), under a normal condition during the period when the hydraulic pressure in the hydraulic chamber (A) of the pressing hydraulic cylinder (1) rises from a no load condition up to a predetermined pressing force, and a pressure holding period set signal (35*a*) corresponding to a number of necessary cycles per unit time of booster actuation, that is, corresponding to the aforementioned measurement signal (33*a*), for supplementing a normal leakage rate of the hydraulic fluid to hold a predetermined pressing force during the period when a pressing force is held, can be preset. In the aforementioned respective processes, that is, in the pressure rising process and in the pressure holding process, the aforementioned measurement signal (33*a*) is compared with the pressure rising period set signal (34*a*) and the pressure holding period set signal (35*a*), respectively, by means of a comparator (36), and there is provided warning means in which when the above-mentioned measurement signal (33*a*)

has exceeded the corresponding set signals (34*a*) and (35*a*), an alarm signal (36*a*) is generated and in response to the alarm signal (36*a*) issued from the comparator (36) an alarm (37) such as a buzzer or the like may be automatically actuated. Furthermore, there is provided operation interruption means responsive to the above-mentioned alarm signal (36*a*) for stopping an automatic operation of the hydraulic vulcanizing press or for controlling the hydraulic vulcanizing press, in the case of the pressing force is being held, not to enter the next cycle when the present cycle has been completed. This operation interruption means itself may possibly take many different forms of known control means depending upon the structure of the hydraulic vulcanizing press, and therefore, description of a more detailed structure of the operation interruption means will be omitted here.

Moreover, modification can be made such that as the set signals (34*a*) and (35*a*), respectively, the pressure rising period setter (34) and the pressure holding period setter (35) respectively can issue two steps of set signals. Then control can be made such that if the measurement signal (33*a*) has exceeded the first step of set signal, then only the alarm (37) is actuated, and if it has exceeded the second step of set signal, then not only the alarm (37) is actuated but also the hydraulic vulcanizing press is subjected to emergency interruption and the operation cycle is stopped.

It is to be noted that while a booster having the structure shown in FIG. 2 has been described as one example of the hydraulic pressure generator device in the above-described preferred embodiment, the hydraulic pressure generator device should not be limited to such a booster but the present invention is also applicable to the case of pressurizing by means of a pump. In addition, while description has been made on a measurement instrument which measures a flow rate of a hydraulic liquid flow indirectly by measuring a booster cycles with the aid of means mounted on a piston of a booster, the present invention should not be limited to this particular example, but it is also possible to detect, for example, the inner pressure of the pneumatic circuit for actuating the booster or of the hydraulic cylinder of the booster by means of a pressure switch. Moreover, it is also possible to employ means for directly detecting the flow rate itself of the hydraulic fluid flow in the hydraulic pressure supplying circuit.

In the following, in connection to a series of operations consisting of clamp, pressure-rise, pressure-hold and unclamp, the operations of the respective component parts will be explained.

Figure 5:
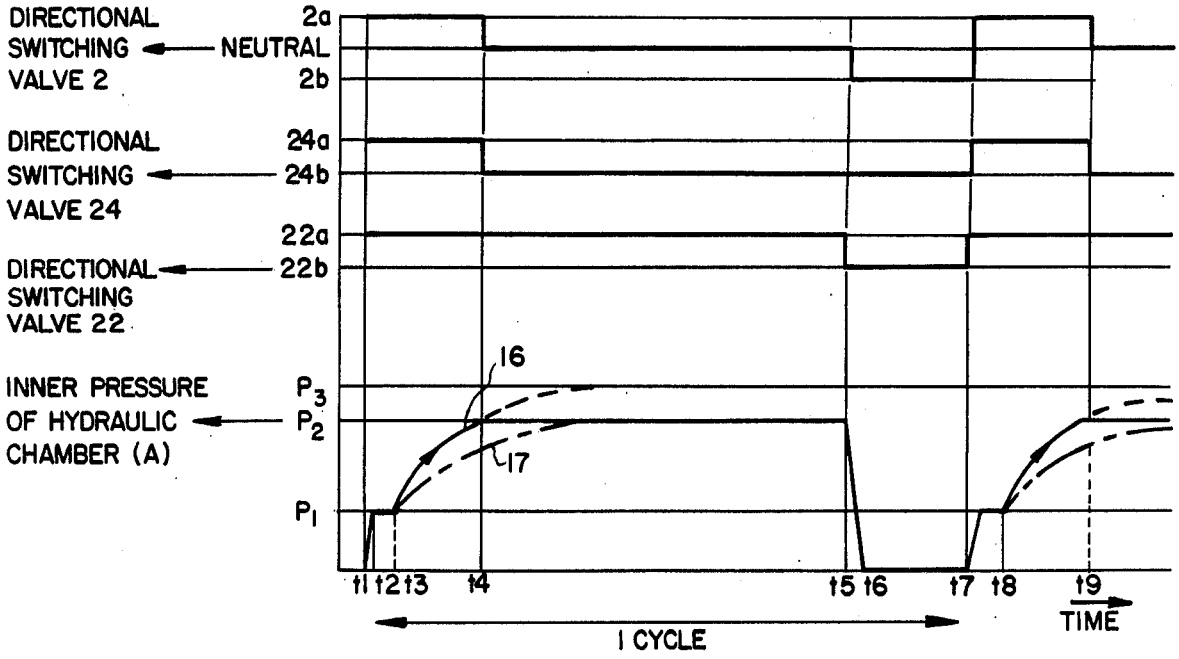
FIG. 5 is a timing chart showing an operation sequence in the system shown in FIG. 2.

FIG. 5 shows variations in time of the operations of the respective switching valves and the inner pressure within the hydraulic chamber (A). The levels 2*a*, neutral and 2*b*, the levels 24*a* and 24*b* and the levels 22*a* and 22*b* represent the respective positions of the directional switching valves 2, 24 and 22, respectively, and the modes of change of the positions of the respective switching valves are indicated by thick solid lines. An inner pressure $P_1$ within the hydraulic chamber (A) is a pressure that is necessary for driving the pressing cylinder 1, and this pressure is equal to the pressure of the low-pressure hydraulic pressure source (3). A presence $P_2$ is a pressure that is necessary for pressing, and this pressure is equal to the pressure obtained with the aid of the booster (10) by the pneumatic pressure $A_2$ controlled through the pressure reducing valve (21). A pressure $P_3$ is a pressure obtained with the aid of the booster (10) by the pneumatic pressure $A_3$ controlled through the pressure reducing valve (25).

Upon pressing with the hydraulic vulcanizing press, at a moment $t_1$, the directional switching valves (2), (24) and (22) are respectively switched to the positions (2*a*), (24*a*) and (22*a*). Owing to the position (2*a*) of the directional switching valve (2), the hydraulic pressure $P_1$ is supplied to the cylinder (1) to drive the cylinder (1), and at a moment $t_2$ the inner pressure within the hydraulic chamber (A) attains the pressure $P_1$. Under this condition, the hydraulic cylinder (1) clamps the metallic moulds. After the molds have been clamped, at a moment $t_3$, a pressurized air at a pressure $A_3$ is fed to the pneumatic booster through the directional switching valve (24) that takes the position (24*a*), as a result, a hydraulic fluid at a pressure $P_3$ is delivered from the pneumatic booster (10), and hence the inner pressure within the hydraulic chamber (A) would rise along a curve (16) shown in FIG. 5. When the inner pressure within the hydraulic chamber (A) has reached the desired pressure $P_2$, that is, at a moment $t_4$, the directional switching valve (24) is switched from the position (24*a*) to the position (24*b*) and the directional switching valve (2) is switched from the position (2*a*) to the position "neutral", so that feed of the air at the pressure $A_3$ to the pneumatic booster (10) is stopped, while the directional switching valve (22) retains its position (22*a*) to feed the air at the pressure $A_2$ corresponding to the desired hydraulic pressure $P_2$, and therefore, the hydraulic chamber (A) is held at the hydraulic pressure $P_2$, and thus the operation enters the pressure holding step.

During the pressure hold period, that is, during the period of $t_4 \rightarrow t_5$, if the pressurized liquid within the hydraulic circuit leaks out and the pressure within the hydraulic chamber (A) is lowered, the pneumatic booster (10) would be automatically driven by the pneumatic pressure $A_2$ fed through the directional switching valve (22) and the booster (10) supplies the pressurized liquid until the pressure within the hydraulic chamber (A) reaches the desired pressure $P_2$.

During the pressure hold period the directional switching valve (2) is kept at the position "neutral" and the directional switching valve (24) is kept at the position (24*b*), but when the pressure hold period has elapsed, that is, when it has become a time $t_5$, the directional switching valve (2) and (22) are switched to the positions (2*b*) and (22*b*), respectively, to release the clamp. When the clamp is released, the inhibit of inverse flowing through the check valve (5) is also released, and so, the pressurized liquid within the hydraulic chamber (A) is discharged through the check valve (5) inversely.

It is to be noted that the switching of the pneumatic circuit from the directional switching valve (24) to the directional switching valve (22) in the above description, that is, the switching of the directional switching valve (24) from the position (24*a*) to the position (24*b*) at the moment $t_4$ is carried out after the pressure switch (6) has been set at the pressure $P_2$.

In connection to the above description, a curve (17) in FIG. 5 represent the mode of growing of the hydraulic pressure in the hydraulic chamber (A) in the event that the pneumatic booster (10) is driven only by the pneumatic pressure $A_2$ corresponding to the desired hydraulic pressure $P_2$. By comparing the curves (16) and (17), it will be readily seen that the pressure rise time can be greatly shortened according to the present invention.

In addition, with regard to the directional switching valve (2), modification could be made such that the neutral position of the valve (2) is omitted to make only two step switching between the positions (2*a*) and (2*b*), at the moment $t_5$ it is switched from the position (2*a*) to the position (2*b*) and the state of the position (2*b*) is maintained from the moment $t_5$ to the moment $t_7$. Alternatively, the directional switching valve (2) may be maintained at the position (2*a*) during the period $t_1 \sim t_3$, it may be switched to the position "neutral" at the moment $t_3$, and it may be maintained at the position "neutral" during the period $t_3 \sim t_5$. Furthermore, the directional switching valve (24) could be switched to the position (24*a*) at the moment $t_3$, then it could be maintained at the state of the position (24*a*) during the period $t_3 \sim t_4$, and switched to the position (24*b*) at the moment $t_4$, and it could be maintained at the state of the position (24*b*) during the period $t_4 \sim t_8$ (corresponding to $t_3$). Still further, the directional switching valve (22) could be switched to the position (22*a*) at the moment $t_4$, maintained at the state of the position (22*a*), then switched to the position (22*b*) at the moment $t_5$ and maintained at the state of the position (22*b*) during the period $t_5 \sim t_9$ (corresponding to $t_4$)

In addition, it is to be noted that lowering of a pressing force of the pressing hydraulic cylinder (1) caused by the conventional leakage of the hydraulic liquid can be prevented by supplying a hydraulic liquid held at the higher pressure $P_2$ with the aid of the hydraulic pressure generator device, that is, the booster (10) to the hydraulic chamber (A) of the pressing hydraulic cylinder (1), and thereby the pressing force produced by the pressing hydraulic cylinder (1) can be maintained at a predetermined value. Furthermore, lowering of the pressing force produced by the pressing hydraulic cylinder (1) would result in increase of a flow rate of the hydraulic fluid (at the hydraulic pressure $P_2$) on the side of the hydraulic pressure supplying circuit (c) with respect to the hydraulic chamber (A) of the pressing hydraulic cylinder (1), and also it is sensitively reflected as increase of cycles of the booster (10). Moreover, since the increase is almost not influenced from the side of the hydraulic vulcanizing press, by comparing a flow rate detected signal of the aforementioned hydraulic fluid flow detected either indirectly or directly with the corresponding set signal, abnormal lowering, that is, lowering exceeding a predetermined value of the pressing force produced by the pressing hydraulic cylinder can be detected appropriately at an early time to generate an alarm, and if necessary it is also possible to automatically stop the hydraulic vulcanizing press in such an abnormal case, hence the present invention can greatly contribute to prevention of unacceptable products, prevention of dangers, etc., and it can remarkably enhance a working efficiency of a hydraulic vulcanizing press. Especially upon holding a pressing force in the case of requiring a long vulcanizing period extending over several tens minutes to several hours as is the case with the tire vulcanizing press, the above-mentioned effects of the present invention is quite remarkable.

What is claimed is:

1. A hydraulic vulcanizing press characterized in that there are provided a pneumatic booster for supplying a hydraulic pressure to a hydraulic circuit on a pressurizing actuation side of a pressing hydraulic cylinder in said hydraulic vulcanizing press in order to pressurize and hold the pressure in the pressing hydraulic cylinder, and a switching device for switching a pressurized air fed to said pneumatic booster between a high pressure air for boosting a hydraulic pressure to a desired hydraulic pressure and a low pressure air for holding said desired hydraulic pressure after said desired hydraulic pressure has been attained.

2. A hydraulic vulcanizing press as claimed in claim 1, characterized in that said switching device is composed of a parallel pneumatic pressure feed circuit including of series connections each consisting of a pressure reducing valve and a directional switching valve, which are connected in parallel to each other between a pneumatic pressure source and said pneumatic booster.

3. A hydraulic vulcanizing press as claimed in claim 2, characterized in that one of the pressure reducing valves in said parallel pneumatic pressure feed circuit is preset so as to feed a high pressure air for boosting the hydraulic pressure to the desired hydraulic pressure, and the other pressure reducing valve is preset so as to feed a low pressure air having a lower pressure than said high pressure air for holding said desired hydraulic pressure.

4. A hydraulic vulcanizing press characterized in that there are provided a hydraulic pressure generator device for supplying a hydraulic pressure to a hydraulic circuit on a pressurizing actuation side of a pressing hydraulic cylinder in said hydraulic vulcanizing press in order to pressurize and hold the pressure in the pressing hydraulic cylinder, and warning means consisting of a measurement instrument for measuring a flow rate of a fluid having said hydraulic pressure and issuing a measurement signal, a setter for issuing a set signal for said flow rate, a comparator for generating an alarm signal when said measurement signal exceeds said set signal and an alarm actuated by said alarm signal.

* * * * *